US007785154B2

(12) United States Patent
Peng

(10) Patent No.: US 7,785,154 B2
(45) Date of Patent: Aug. 31, 2010

(54) NETWORK JACK AND PROCESSING METHOD FOR THE SAME

(76) Inventor: John Peng, 4F., No. 12, Lane 270, Sec. 3, Beishen Rd., Shenkeng Township, Taipei County (TW) 222

( * ) Notice: Subject to any disclaimer, the term of this patent is extended or adjusted under 35 U.S.C. 154(b) by 0 days.

(21) Appl. No.: 12/338,280

(22) Filed: Dec. 18, 2008

(65) Prior Publication Data

US 2010/0048064 A1 Feb. 25, 2010

(30) Foreign Application Priority Data

Aug. 19, 2008 (TW) ..... 97131655 A

(51) Int. Cl.
*H01R 13/625* (2006.01)

(52) U.S. Cl. ..... 439/676

(58) Field of Classification Search ..... 439/676, 439/76.1, 344, 189, 395
See application file for complete search history.

(56) References Cited

U.S. PATENT DOCUMENTS 6,641,443 B1 * 11/2003 Itano et al. ..... 439/676
6,786,776 B2 9/2004 Itano et al.

* cited by examiner

*Primary Examiner*—T C Patel
*Assistant Examiner*—Phuong Nguyen
(74) *Attorney, Agent, or Firm*—Volpe and Koenig P.C.

(57) ABSTRACT

The network jack and processing method for the network jack are provided. The network jack connects a device to a network and includes a jack body, a printed circuit board configured inside the jack body, and a contacting pin including a transmitting portion having a straight configuration and a fixing portion fixed to the printed circuit board.

18 Claims, 10 Drawing Sheets

NETWORK JACK AND PROCESSING METHOD FOR THE SAME

FIELD OF THE INVENTION

The invention relates to a network jack and processing method for the same, and more particularly to a Keystone jack and processing method for the same.

BACKGROUND OF THE INVENTION

In a typical Keystone jack for network communication, a supporting portion is normally arranged therein for supporting contacting pins (i.e. gold-plated pins). The supporting portion can be simply classified into two types, one of which provides a resilient force to contacting pins, and the other of which does not provide such resilient force. As for the supporting portion providing the resilient force to contacting pins, it is normally made of the material with strong resiliency.

Referring to FIG. 1, it illustrates internal structure of a network jack 10 disclosed in U.S. Pat. No. 6,786,776 B2. Eight contacting pins 11 in the form of plates are fixed to a printed circuit board 13, in which the fixing ends of the contacting pins 11 are separated into an upper and a lower rows so that the contacting pins 11 are extended forward from the printed circuit board 13. In order to eliminate crosstalk during signal transmitting, the contacting pins 11 may irregularly bend or curve upward or downward. After being further extending above a spring arm 14, which is a supporting portion providing the resilient force, the front extension directions meet together so that the front extension portions of contacting pins 11 are parallel. In addition, each of the contacting pins 11 has a contacting portion 15 electrically connected to a network plug and bends downward from a bending point 16. However, the processing method for manufacturing the contacting pins 11 is very complicated, and scheme to mount the eight intricate contacting pins 11 to the printed circuit board 13 is very struggling.

Referring to FIG. 2, in order to prevent the contacting pins 11 from shifting leftward or rightward, a head portion 20 of the spring arm 14 acts as a supporting point, and a left and a right side skirts (only the left side skirt 21 shown in FIG. 2) are respectively projected from the contacting portion 15 of each of the contacting pins 11 against the lateral movement of the head portion 20 of the spring arm 14 therebetween. However, the above-mentioned additional process for manufacturing the side skirts makes it more complicated and struggling in processing and assembling the contacting pins 11, which results in increasing the cost.

Therefore, to overcome the drawbacks from the above complicated method for processing the conventional contacting pins with various bending or curving portions and adding side skirts on the contacting pins, the Applicant dedicated in considerable experimentation and research, and finally accomplishes the "network jack and processing method for the same" of the present invention, which overcomes the above drawbacks regarding the inconvenience in processing the conventional contacting pins and adding the side skirts.

Therefore, the invention is intended to solve the following problems:

1. to overcome the inconvenience of mounting a upper and a lower rows of the contacting pins to the printed circuit board, and develop an easier method for processing contacting pins in a network jack;

2. to overcome such complicated process of manufacturing left and right side skirts for fixing the spring arm or other supporting portions; and
3. to develop a solution that allows a network plug able to be electrically connected to the contacting pins without bending the contacting pins.

The invention is briefly described as follows.

SUMMARY OF THE INVENTION

In accordance with one aspect of the present invention, a network jack connecting a device to a network is provided. The network jack comprises a jack body, a printed circuit board configured inside the jack body, and a contacting pin comprising a transmitting portion having a straight configuration and a fixing portion fixed to the printed circuit board.

Preferably, the contacting pin further comprises a plug contacting portion electrically connected to a network plug, the jack body has an outward face, and the printed circuit board is configured substantially parallel to the outward face.

Preferably, the contacting pin further comprises a bent end located opposite to the fixing portion and facilitating the network plug being inserted into the network jack.

Preferably, the network jack further comprises a supporting portion including a protrusion having an elongated face holding the plug contacting portion.

Preferably, the supporting portion has a substantially S-shaped configuration with a top to be pressed downward when the network plug is inserted into the network jack.

Preferably, the top of the supporting portion moves upward to restore the substantially S-shaped configuration when the network plug is removed.

Preferably, the supporting portion has a substantially Z-shaped configuration with a top to be pressed downward when the network plug is inserted into the network jack.

Preferably, the jack body has an elongated wall and the supporting portion has a recess accommodating the elongated wall.

Preferably, the supporting portion has a lateral sliding portion for sliding into the jack body and has a base and a rib strengthening the base.

Preferably, the jack body has a recess accommodating the contacting pin including a plug contacting portion electrically connected to a network plug, a first bending portion connecting the transmitting portion and the plug contacting portion, and a second bending portion located opposite to the fixing portion and facilitating the network plug being inserted into the network jack.

Preferably, the recess of the network jack has two lateral walls fixing the contacting pin.

Preferably, the transmitting portion has a length substantially ranged between 54~63% of a total length of the contacting pin, and the fixing portion is riveted into the printed circuit board.

Preferably, the transmitting portion has a length ranged between 57~63% of a total length of the contacting pin.

In accordance with the second aspect of the present invention, a network jack is provided. The network jack includes a jack body, a printed circuit board configured inside the jack body, and a conductor fixed to the printed circuit board and including a transmitting portion having a straight configuration.

Preferably, the network jack is configured to connect a device to a network, wherein the conductor is a contacting pin made of a metal.

Preferably, the conductor further includes a fixing portion fixed to the printed circuit board.

In accordance with further aspect of the present invention, a processing method for a network jack is provided. In the processing method, the network jack includes a printed circuit board and a jack body. The method includes the steps of providing a contact having a transmitting portion with a straight configuration and configured inside the jack body, and assembling the printed circuited board with the jack body.

Preferably, the contact further includes a fixing portion fixed to the printed circuit board and an end portion opposite to the fixing portion. The processing method further includes a step of bending the end portion to facilitate a network plug being inserted into the network jack.

Preferably, the jack body further includes a resilient device therein. The processing method further includes a step of pressing the resilient device to provide an upward resilient force thereon.

Preferably, the processing method further includes a step of supporting the transmitting portion so as to generate a return resilient force therefrom.

Based on the above descriptions for the aspects of the invention, it is able to be understood that the network jack and the processing method thereof of the present invention are implemented by utilizing a contacting pin having a transmitting portion with a straight configuration so that a plurality of contacting pins in a single row are mounted to the printed circuit board and applying a recess having two lateral walls fixing the contacting pin to avoid shifting left- or rightward.

The above aspects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
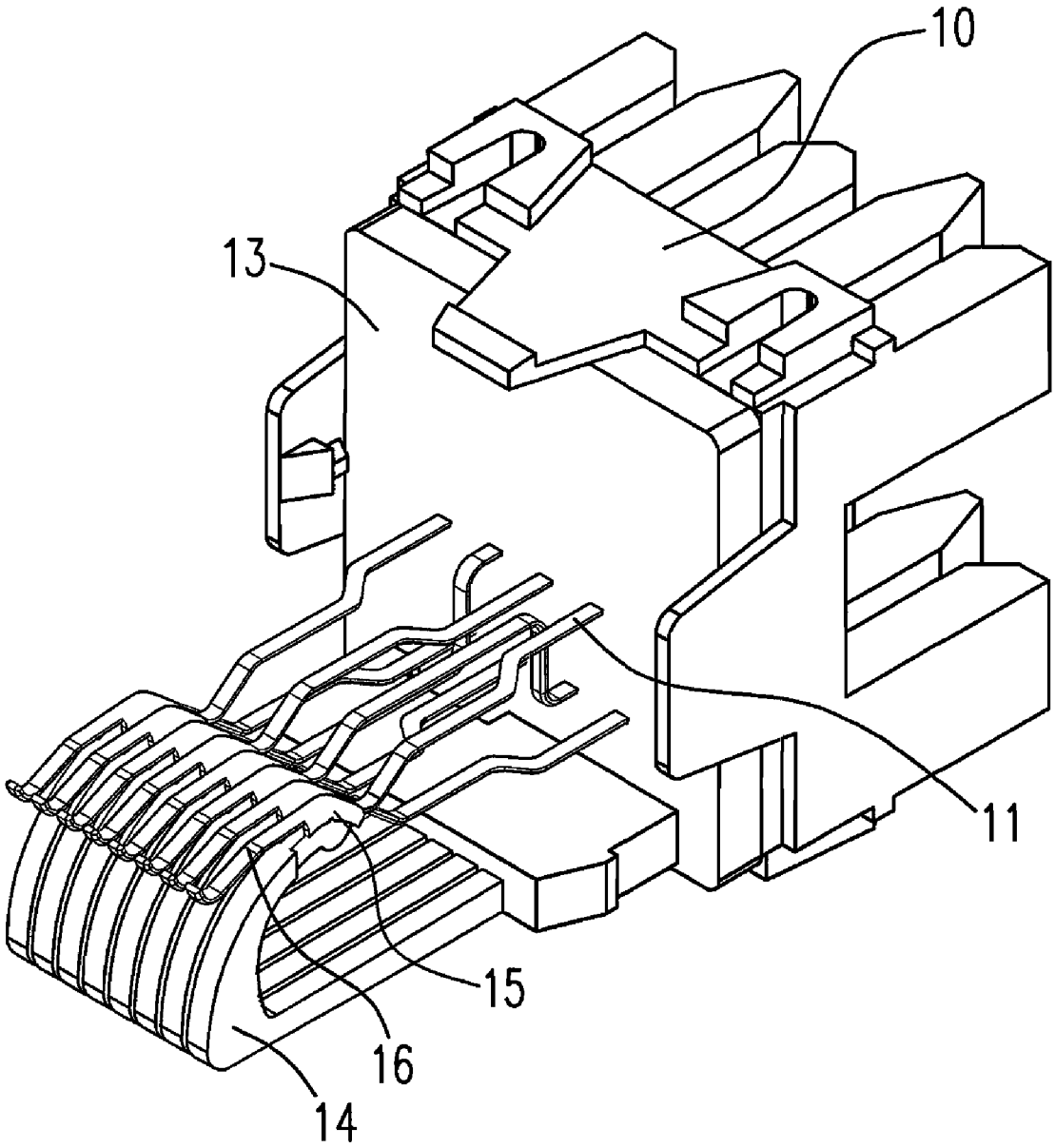
Fig. 1 (PRIOR ART)
FIG. 1 is a perspective view illustrating a conventional network jack with contact pins assembling with the printed circuit board.
Figure 2:
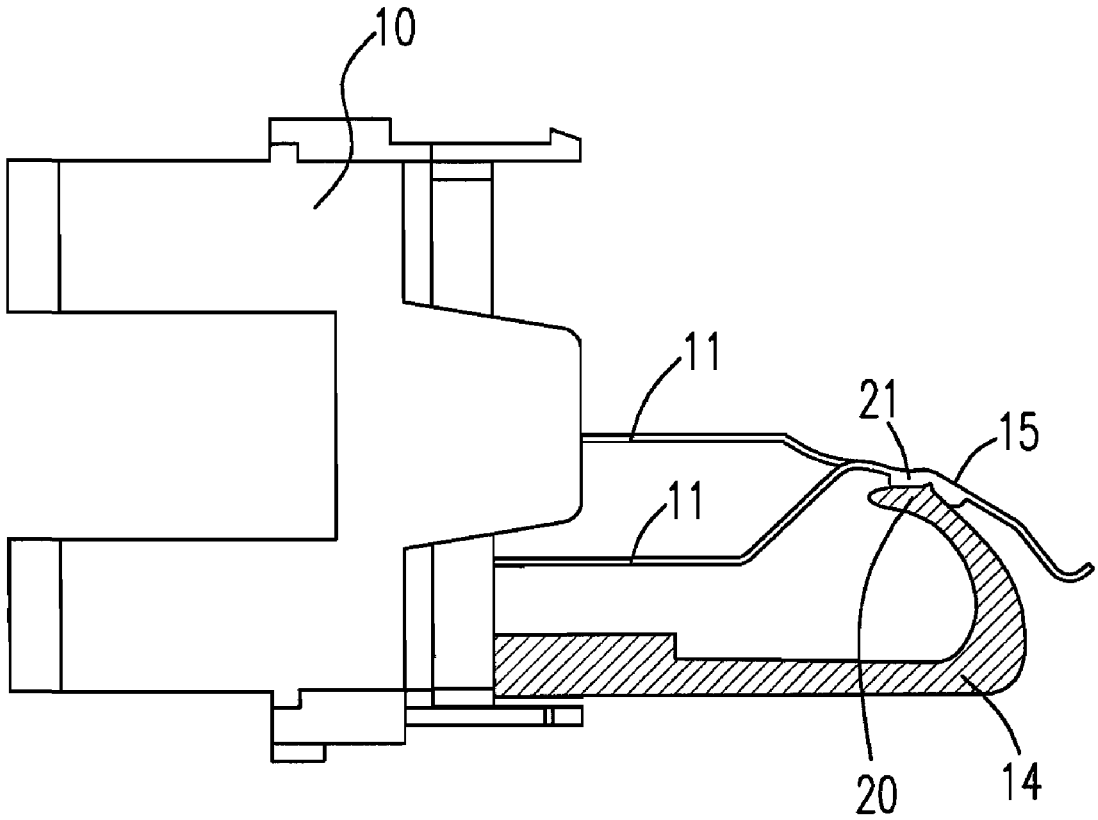
Fig. 2(PRIOR ART)
FIG. 2 is a side cross-sectional view illustrating the contact pins and the supporting portion shown in FIG. 1.
Figure 3:
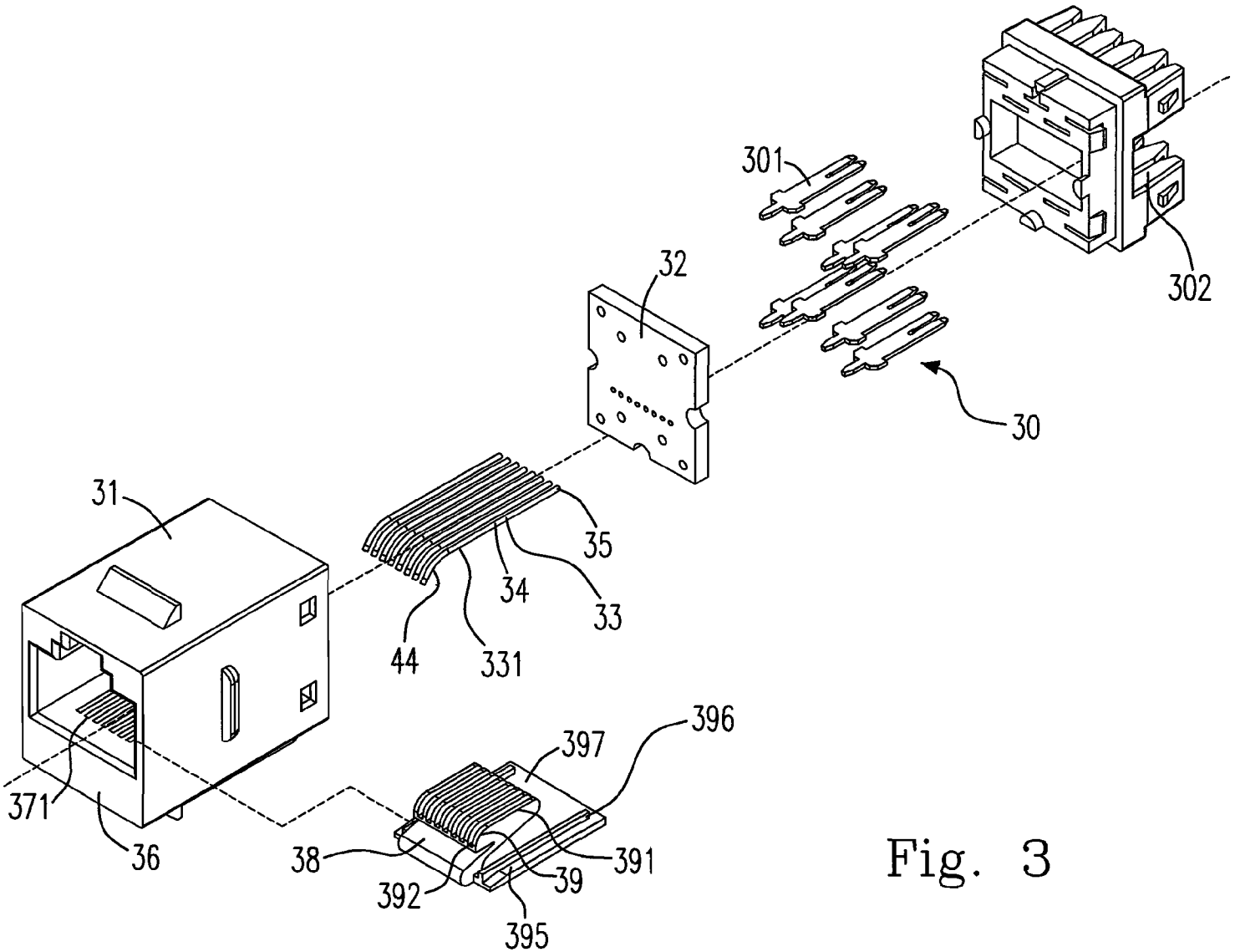
FIG. 3 is an exploded view illustrating the network jack according to a preferred embodiment of the present invention.

Referring to FIG. 3, it illustrates a network jack 30 connecting a device e.g. a computer, to a network. The network jack 30 includes a jack body 31, a printed circuit board 32 configured inside the jack body 31, and eight contacting pins 33 mounted to the printed circuit board 32.

The contacting pins 33 can be gold-plated pins with round cross-sectional shapes, which are very solid in physical property. The respective contacting pins 33 include a transmitting portion 34 having a straight configuration and a fixing portion 35 fixedly riveted to the printed circuit board 32. Preferably, the respective contacting pins 33 further include a plug contacting portion 331.

Since the universal printed circuit board 32 at present is capable of eliminating crosstalk in signal transmission, there is no need to bend the contacting pins 33. Furthermore, the printed circuit board 32 is arranged with eight pierce terminals 301 and a terminal block 302. Therefore, the transmitting portion 34 in the present invention without bending portions still can work well in signal transmission without significant crosstalk.

Preferably, the transmitting portion 34 has a length substantially ranged between 54~63% of a total length of the respective contacting pins 33. More preferably, the transmitting portion 34 has a length ranged between 57~63% of a total length of the respective contacting pins 33. Most preferably, the transmitting portion 34 has a length ranged between 57.89% of a total length of the respective contacting pins 33. For example, the transmitting portion 34 is 20.11 mm in length when the respective contacting pins 33 is 34.74 mm in length.

The jack body 30 of the network jack 30 has an outward face 36, and the printed circuit board 32 is configured substantially parallel to the outward face 36. The jack body 31 has eight recesses 371 accommodating the above eight contacting pins 33. The network jack 30 further includes a supporting portion 38 including a protrusion 39 having an elongated face 391. The supporting portion 38 has seven recesses 392. In addition, the supporting portion 38 has a lateral sliding portion 395 for sliding into the jack body 31 and has two ribs 396 strengthening a base 397 of the supporting portion 38.

Figure 4:
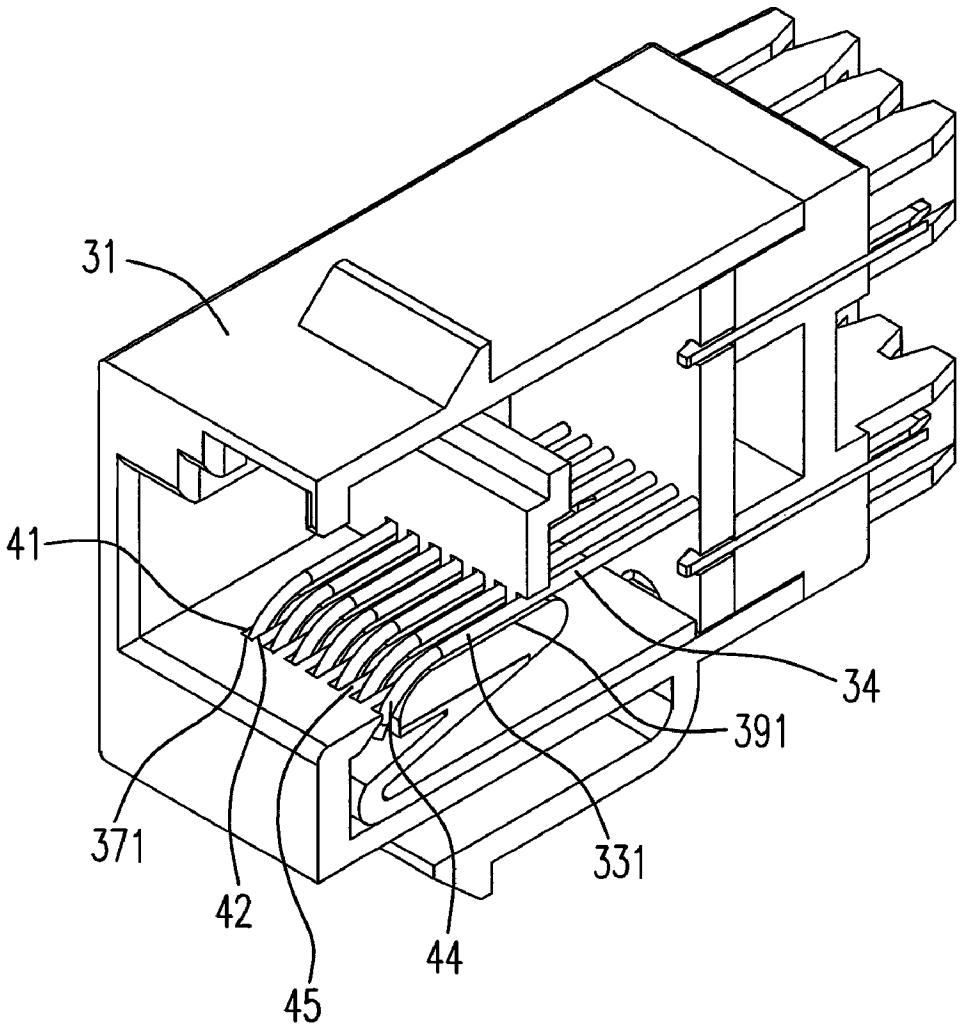
FIG. 4 is a perspective view illustrating the assembly of the network jack shown in FIG. 3

Referring to FIG. 4, each of recesses 371 of the jack body 31 can have a left lateral wall 41 and a right lateral wall 42 to fix each of the contacting pins 33, so as to prevent the contacting pins 33 from lateral shifting. The contacting pins 33 further includes a bent end 44 located opposite to the fixing portion 35. The above elongated face 391 is applied to support the plug contacting portion 33. The recesses 392 of the supporting portion 38 accommodate seven elongated walls 45 (only six elongated wall shown in the cross-sectional view in FIG. 4).

Figure 5:
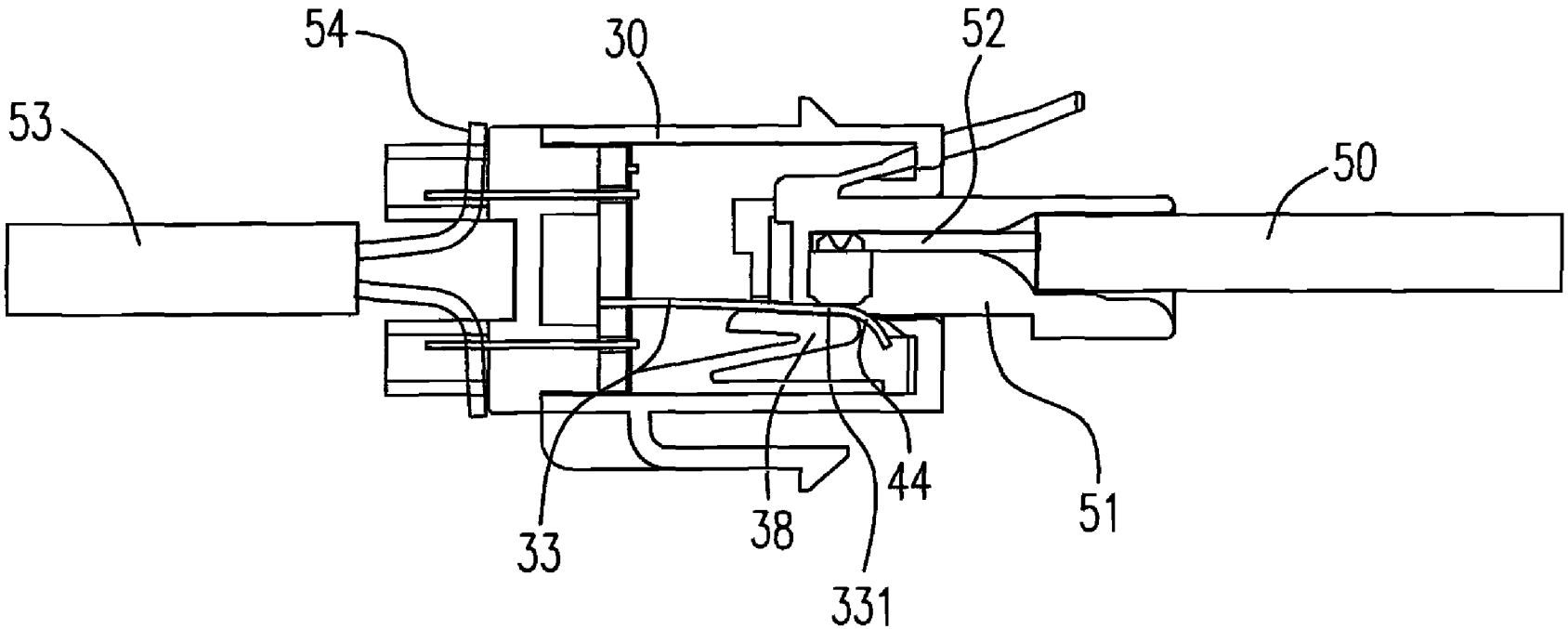
FIG. 5 is a side cross-sectional view illustrating a network plug connected to the network jack shown in FIG. 3.

Referring to FIG. 5, the bend end 44 in each of the contacting pins is to facilitate the network plug 51 of a network jumper wire 50 being inserted into the network jack 30 so that the plug contacting portion 331 is able to be connected to the network plug 51. There are eight core wires 52 inside the network jumper wire 50 and eight core wires 54 network cable 53.

Figure 6:
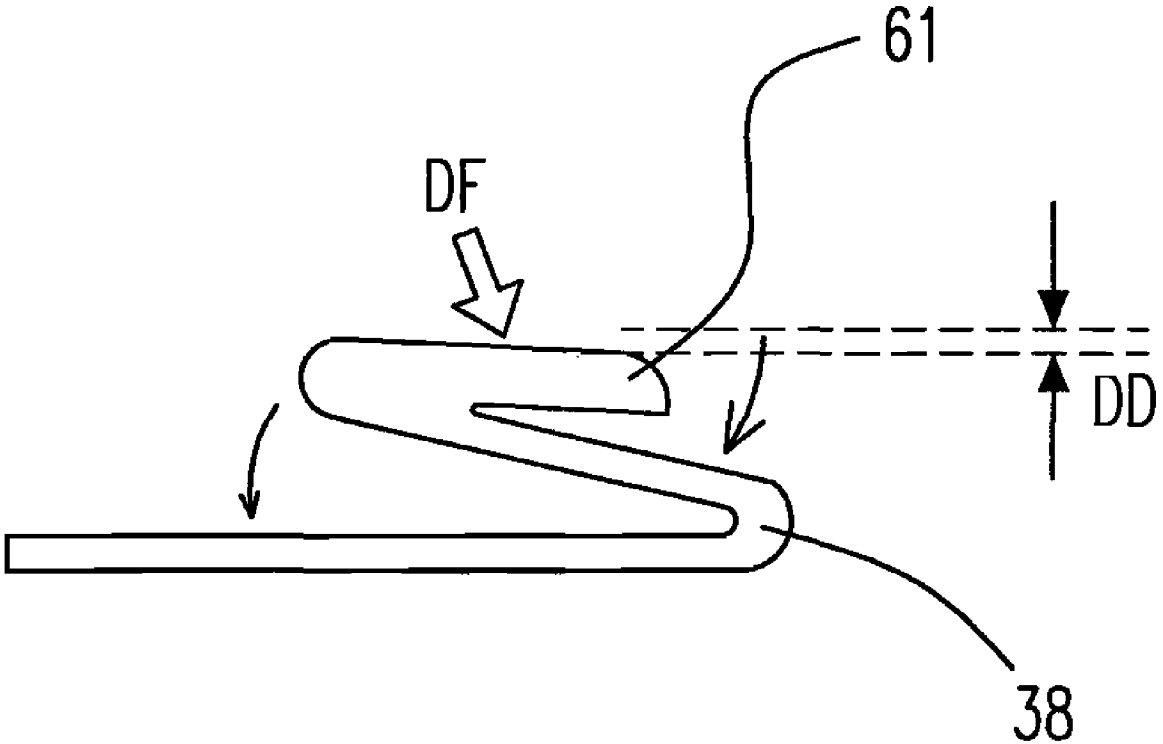
FIG. 6 is a side view illustrating the movement of one preferred supporting portion mounted as shown in FIG. 5 when it is in response to pressure.
Figure 7:
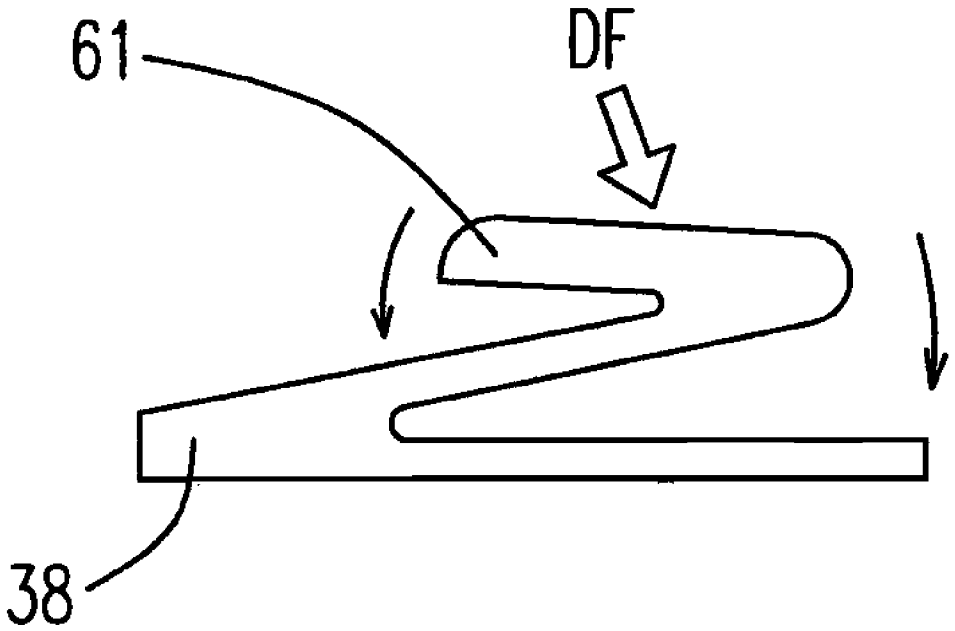
FIG. 7 is a side view illustrating the movement of another preferred supporting portion mounted as shown in FIG. 5 when it is in response to pressure.

Referring to FIG. 6, the supporting portion 38 of the network jack 30 has a substantially S-shaped configuration. When the network plug 51 is inserted into the network jack 30, the network plug 51 contacts the contacting pins 33 (see FIG. 5). A downward pressure DF is produced when a top 61 of the supporting portion 38 contacts the contacting pins 33 so that the supporting portion 38 deforms downward and in the mean time the top 61 is pressed downward with a downward displacement DD. After the network plug 51 is removed from the network jack 30, the top 61 of the supporting portion 38 moves upward to restore the substantially S-shaped configuration. Hence, the supporting portion 38 enables the contacting pins to return back the original shape. Moreover, for signal transmission, the important function of the supporting portion 38 is to provide resiliency maintaining the optimal connection between the contacting pins 33 and the network plug 51. Therefore, the connection would not be interrupted duo to unstable external force. Referring to FIG. 7, the supporting portion 38 can have a substantially Z-shaped configuration and the top 61 is to be pressed downward with a downward displacement when the network plug 51 is inserted in the network jack 30 (see FIG. 5).

Figure 8:
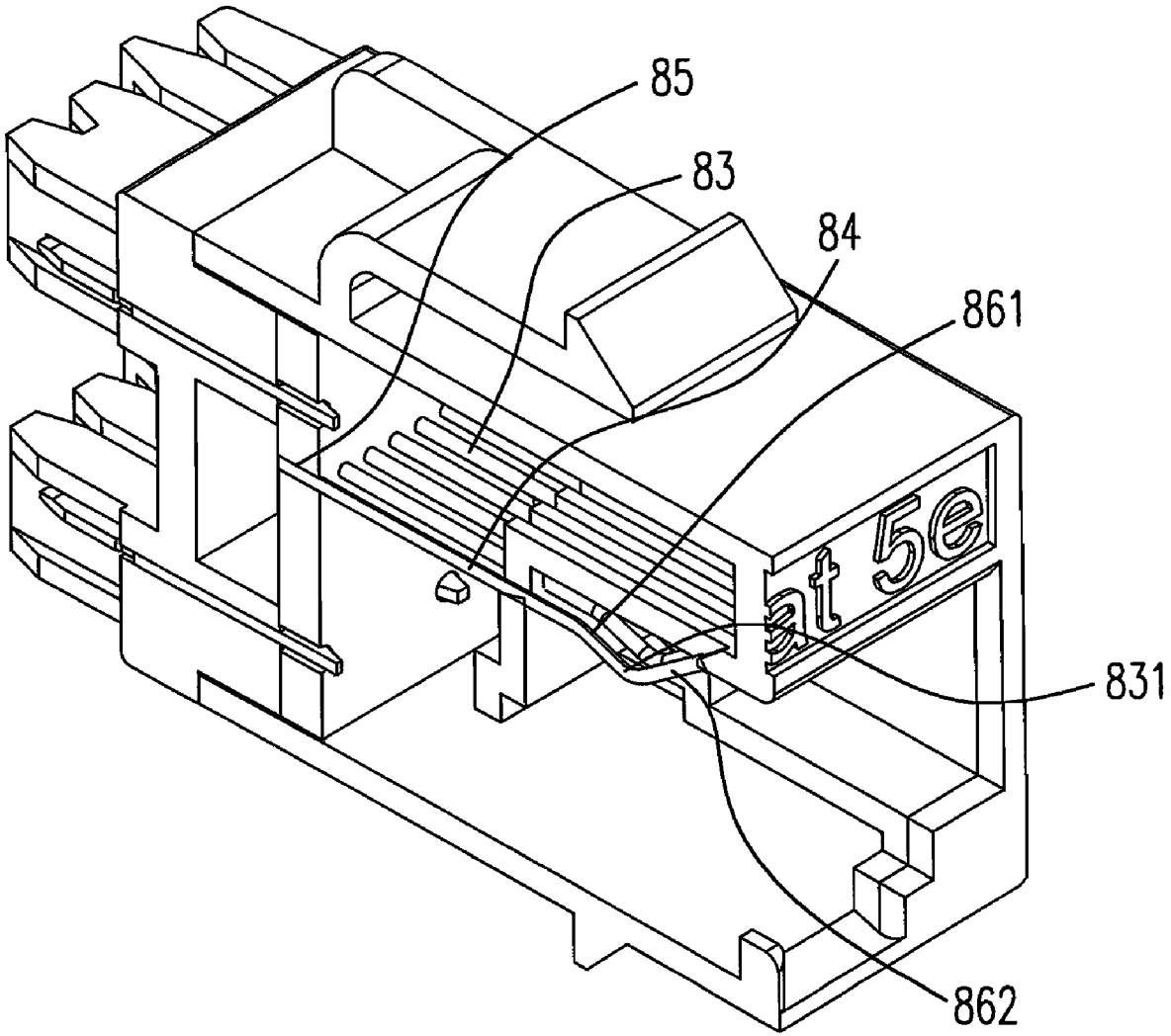
FIG. 8 is a cross-sectional view illustrating the network jack according to another embodiment of the present invention.

Referring to FIG. 8, it illustrates another embodiment of the prevent invention. Each of the contacting pins 83 has a transmitting portion 84 and a fixing portion 85. Furthermore, each of the contacting pins 83 also has a plug contacting portion 831, a first bending portion 861 and a second bending portion 862. The first bending portion 861 is applied to connect the transmitting portion 84 and the plug contacting portion 831. With the above two bending portions, the first bending portion 861 is to be pressed to provide a larger resilient force without the support of the supporting portion.

Figure 9:
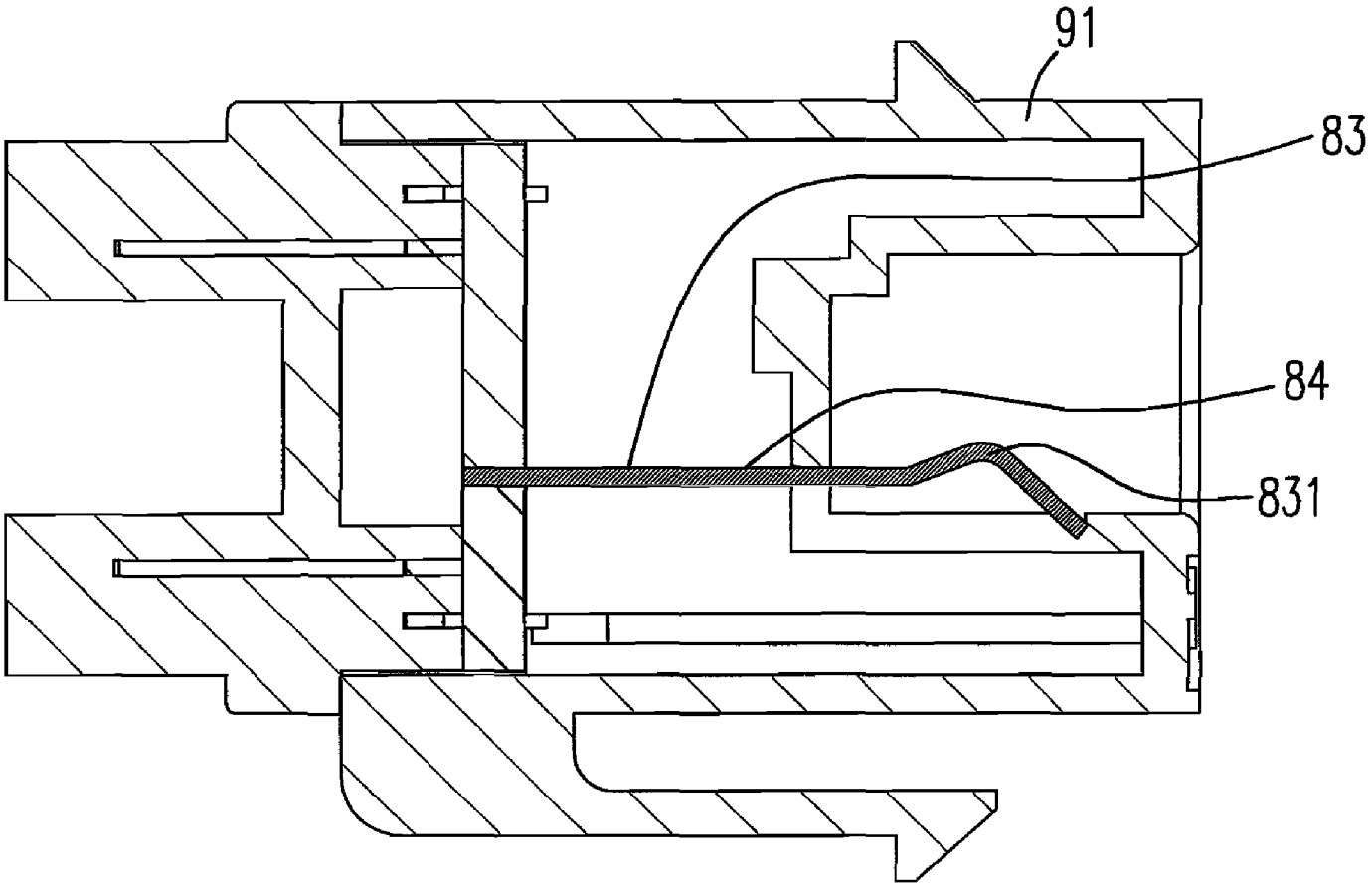
FIG. 9 is a side view illustrating the network jack as shown in FIG. 8.

Further referring to FIG. 9, the configuration of the contacting pin 83 in the jack body 91 is further shown therein. The contacting pin 83 has 19.72 mm of the transmitting portion 84, which is ranged for 57.21% of 34.47 mm of the total length.

Figure 10:
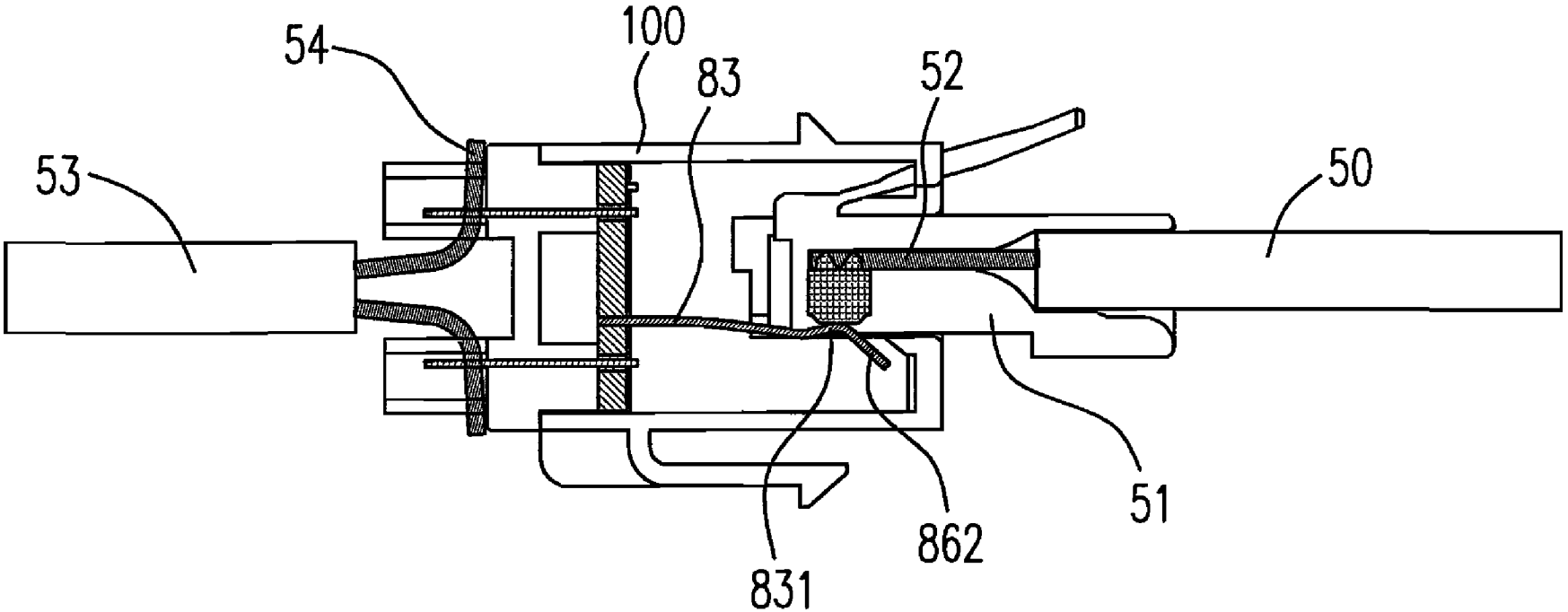
FIG. 10 is a side cross-sectional view illustrating a network plug connected to the network jack shown in FIG. 8.

Referring to FIG. 10, the second bending portion 862 of the network jack 100 in the embodiment of FIG. 9 is to facilitate the network plug 51 being inserted into the network jack 100. The plug contacting portion 831 is applied to be electrically connected to the network plug 51.

According to another aspect of the present invention, a network jack 30 is provided. The network jack 30 includes a jack body 31, a printed circuit board 32 configured inside the jack body, a conductor fixed to the printed circuit board 32, in which the conductor has a transmitting portion 34 having a straight configuration. The conductor may be, but is not limited to, contacting pins 33 made of a metal, such as a gold-plated pin, and can further includes a fixing portion 35 fixed to the printed circuit board 32. Certainly, such jack can connect a device to a network.

According to further aspect of the present invention, a processing method for a network jack 30 is provided. In this method, the network jack 30 includes a printed circuit board 32 and a jack body 31. The method includes the steps of providing a contact (such as eight contacting pins 33) having a transmitting portion 34 with a straight configuration and configured inside the jack body, and assembling the printed circuited board 32 with the jack body 31. Preferably, the contact further includes a fixing portion 35 fixed to the printed circuit board and an end portion 44 opposite to the fixing portion 35.

The processing method further includes a step of bending the end portion 44 to facilitate a network plug 51 being inserted into the network jack 30.

Preferably, the jack body 31 further includes a resilient device, such as the above supporting portion 38 therein. The processing method further includes a step of pressing the resilient device to provide an upward resilient force thereon. Preferably, the processing method further includes a step of supporting the transmitting portion 34 so as to generate a return resilient force therefrom.

In conclusion, based on the novel design of the present invention, the network jack and the processing method thereof of the present invention are implemented by utilizing a contacting pin having a transmitting portion with a straight configuration so that a plurality of contacting pins in a single row are mounted to the printed circuit board and applying a recess having two lateral walls fixing to the contacting pin so that the contacting pins are prevented from shifting left- or rightward.

Based on the above descriptions, it is understood that the present invention is indeed an industrially applicable, novel and non-obvious one with values in industrial development. While the invention has been described in terms of what are presently considered to be the most practical and preferred embodiments, it is to be understood that the invention should not be limited to the disclosed embodiment. On the contrary, it is intended to cover numerous modifications and variations included within the spirit and scope of the appended claims which are to be accorded with the broadest interpretation so as to encompass all such modifications and variations. Therefore, the above description and illustration should not be taken as limiting the scope of the present invention which is defined by the appended claims.

What is claimed is:

1. A network jack connecting a device to a network, comprising:

a jack body;

a printed circuit board configured inside the jack body;

a contacting pin having a round cross-sectional shape and comprising: a transmitting portion having a straight configuration; and a fixing portion fixed to the printed circuit board; and a supporting member having a substantially S-shaped or a substantially Z-shaped configuration, the supporting member has a top to be pressed downward when a network plug is inserted into the network jack.

2. The network jack as claimed in claim 1, wherein the top of the supporting member moves upward to restore the substantially S-shaped configauration when the network plug is removed.

3. The network jack as claimed in claim 1, wherein the jack body has a recess accommodating the contacting pin comprising:

a plug contacting portion, electrically connected to a network plug;

a first bending portion, connecting the transmitting portion and the plug contacting portion; and a second bending portion located opposite to the fixing portion and facilitating the network plug being inserted into the network jack.

4. The network jack as claimed in claim 3, wherein the recess has two lateral walls fixing the contacting pin.

5. The network jack as claimed in claim 1, wherein the transmitting portion has a length substantially ranged between 54~63% of a total length of the contacting pin, and the fixing portion is riveted into the printed circuit board.

6. The network jack as claimed in claim 5, wherein the transmitting portion has a length ranged between 57~63% of a total length of the contacting pin.

7. The network jack as claimed in claim 1, wherein the contacting pin further comprises a plug contacting portion electrically connected to the network plug, the jack body has an outward face, and the printed circuit board is configured substantially parallel to the outward face.

8. The network jack as claimed in claim 7, wherein the contacting pin further comprises a bent end located opposite to the fixing portion and facilitating the network plug being inserted into the network jack.

9. The network jack as claimed in claim 8 wherein the supporting member includes a protrusion having an elongated face holding the plug contacting portion.

10. The network jack as claimed in claim 9, wherein the jack body has an elongated wall and the supporting member has a recess accommodating the elongated wall.

11. The network jack as claimed in claim 9, wherein the supporting member has a lateral sliding portion for sliding into the jack body and has a base and a rib strengthening the base.

12. A network jack, comprising:

a jack body;

a printed circuit board configured inside the jack body;

a conductor having a round cross-sectional shape, fixed to the printed circuit board and comprising:

a transmitting portion having a straight configuration; and a supporting member having a substantially S-shaped configuration or a substantially Z-shaped configuration, the supporting member has a top to be pressed downward when a network plug is inserted into the network jack.

13. The network jack as claimed in claim 12 configured to connect a device to a network, wherein the conductor is a contacting pin made of a metal.

14. The network jack as claimed in claim 12, wherein the conductor further comprises a fixing portion fixed to the printed circuit board.

15. A processing method for a network jack, wherein the network jack comprises a printed circuit board and a jack body, the method comprises the steps of:

providing a contact having a round cross-sectional shape, a transmitting portion with a straight configuration and a supporting member with a substantially S-shaped configuration or a substantially Z-shaped configuration, the contact being configured inside the jack body; and assembling the printed circuited board with the jack body;

wherein said substantially S-shaped or the substantially Z-shaped configuration, has a top to be pressed downward when a network plug is inserted into the network jack.

16. The processing method as claimed in claim 15, wherein the contact further comprises a fixing portion fixed to the printed circuit board and an end portion opposite to the fixing portion, further comprising a step of bending the end portion to facilitate a network plug being inserted into the network jack.

17. The processing method as claimed in claim 15, wherein the jack body further comprises a resilient device therein, further comprising a step of pressing the resilient device to provide an upward resilient force thereon.

18. The processing method as claimed in claim 15 further comprising a step of supporting the transmitting portion so as to generate a return resilient force therefrom.

* * * * *